US009928719B1

(12) United States Patent
Webb

(10) Patent No.: US 9,928,719 B1
(45) Date of Patent: Mar. 27, 2018

(54) LIFE GUARD POOL PATROL

(71) Applicant: Dorothy Lee Webb, Maricopa, AZ (US)

(72) Inventor: Dorothy Lee Webb, Maricopa, AZ (US)

( * ) Notice: Subject to any disclaimer, the term of this patent is extended or adjusted under 35 U.S.C. 154(b) by 9 days.

(21) Appl. No.: 15/330,952

(22) Filed: Oct. 6, 2014

Related U.S. Application Data

(60) Provisional application No. 61/961,202, filed on Oct. 8, 2013.

(51) Int. Cl.
*G08B 23/00* (2006.01)
*G08B 21/08* (2006.01)

(52) U.S. Cl.
CPC ..... *G08B 21/084* (2013.01); *G08B 21/08* (2013.01)

(58) Field of Classification Search
CPC ..... G08B 21/084; G08B 21/082; G08B 21/08
USPC ..... 340/573.4
See application file for complete search history.

(56) References Cited

U.S. PATENT DOCUMENTS 5,886,630 A * 3/1999 Menoud ..... G08B 21/082 340/540
6,133,838 A * 10/2000 Meniere ..... G08B 21/082 340/573.6
6,642,847 B1 * 11/2003 Sison ..... G08B 21/082 340/573.6
7,047,092 B2 * 5/2006 Wimsatt ..... G05B 15/02 345/173

* cited by examiner

*Primary Examiner* — John A Tweel, Jr.
(74) *Attorney, Agent, or Firm* — Keith L. Jenkins, Registered Patent Attorney, LLC; Keith L. Jenkins

(57) ABSTRACT

A swimming pool alarm that senses arise in the water level of a pool when a person inadvertently enters the pool. The alarm system includes pairs of battery-powered motion sensors that detect a change in the water level and communicate wirelessly to a receiver in a control panel, which then generates a visual and audible alarm. The motion sensors are releasably attached to a pool wall and adjusted to place the surface of the pool water within the sensor field of view. Each motion sensor is housed with a communicatively coupled transmitter. When motion of the pool surface is detected, the transmitter communicates to the control panel and an alarm is generated. A key fob remote control is provided for activating and deactivating the control panel. The motion sensors are always on. The system is off when the control panel stops receiving.

18 Claims, 3 Drawing Sheets

LIFE GUARD POOL PATROL

CROSS-REFERENCE TO RELATED APPLICATIONS

This application claims the priority of provisional application Ser. No. 61/461,202 filed on Oct. 8, 2013.

BACKGROUND OF THE INVENTION

Life Guard Pool Patrol, originally named Nika's Flash Pool Patrol, is a pool alarm that aids in protecting your family from accidental drowning. The objective of this device is to help in reducing the number of people killed by drowning across the country. This device detects a shift in water level possibly caused by someone falling into the pool and it will sound off a piercing alarm alerting anyone in or around the house and possibly neighbors.

When I was 6 years old, my brother pushed me into a pool and I could not swim. He told our younger brother to run home and get our father, while he stood at the edge of the pool watching me drown. He did not know how to swim either. Only a minute passed, but it felt like eternity, when my father pulled me out. This experience has followed me all my life and hindered me severely; I never learned to swim after all these years.

As I got older, I would hear all these stories on the news about drowning and/or near-drowning. I would think to myself how these were completely avoidable tragedies. But, it would not be until 53 years after my near-drowning experience that this idea of a pool alarm began to form. It was after I had adopted my mentally-challenged daughter. She would always want to go to the pool with her sisters who could swim, while she could not. I was so afraid that she would have an experience like mine and that is when I thought about an alarm that would alert people of someone possibly drowning in a pool. It would save many lives and give peace of mind to parents and swimming pool owners.

BRIEF SUMMARY OF THE INVENTION

Have you ever swam unattended in a pool? Have you ever been watching kids around the pool and had to step away, even for a couple of seconds? Have you ever been so busy that you took your eyes off the children for a minute, whether inside or outside of the house? If so, you are putting yourself and others at risk for a potential drowning accident. With Life Guard Pool Patrol, you can put your mind at ease. Life Guard Pool Patrol is a warning system for your swimming pool. The motion sensor transmitter mounts to the pool wall above the waterline. The control panel receiver is placed in a user's home. When the water level of the pool rises from any object weighing at or more than 20 pounds, the alarm will sound and a red LED light will flash continuously until manually deactivated. A key fob comes with the device so it can be activated and/or deactivated remotely.

Advantages of the safety device are that an alert is activated the instant a child or any non-swimmer is in an unattended pool and it reduces the likelihood of a tragic outcome. It affords peace of mind for parents or any other swimming pool owner. It can be operated by a key fob remote control for convenience. The design is for newly installed or existing pools. The device is producible as an aftermarket kit.

The safety device alerts property owners when a child or any non-swimmer enters the pool without supervision when the alarm is activated. The system sounds an alarm inside the residence when someone breaks the motion sensor beam of the transmitter.

Life Guard Pool Patrol is an electronic pool safety device that consists of motion sensor transmitters that are installed around the perimeter and attach just about at the waterline of the pool and an inside or outside wall-mounted control panel receiver that can be operated manually or by a remote control key fob. Each pool motion sensor transmitter measures around 3 inches and the control panel receiver measures around 3 inches long by 5 inches wide. The control panel receiver features an "ACTIVATE" button, and "OFF" button, light emitting diodes (LEDs), and a speaker. Once the alarm is activated by control panel or remote, a green light will come on accompanied by a voice alert that broadcasts "pool alarm activated." When a child or other individual falls into the pool, the water level will rise, breaking the sensor's beam. This action will activate a loud piercing alarm and cause the red LED to flash on and off. The alarm and flashing light will continue until the alarm is turned off manually or remotely, then a voice alert will broadcast "pool alarm deactivated."

This alarm will significantly cut down on, if not completely eliminate, the number of drownings and near-drownings. While this invention does not replace the need for supervision around the pool, it does give peace of mind to parents, family members, and pool owners alike. It is a back-up system to ensure the safety of our loved ones around water.

BRIEF DESCRIPTION OF THE SEVERAL VIEWS OF THE DRAWINGS

The present invention will hereinafter be described in conjunction with the following drawing figures, wherein like numerals denote like elements.

DETAILED DESCRIPTION OF THE INVENTION

When a child or non-swimmer weighing 20 pounds or more enters the pool, while alarm is activated, the water level will rise enough to cause the motion sensor transmitter to send the signal to the receiver, thus activating a loud, piercing sound and a flashing red light. The idea is to alert the parent/guardian to go check the pool immediately in hopes of pulling out the person before body or brain damage, or worse yet, death, occur. The alarm sound is loud enough for neighbors to hear as well. The alarm must be deactivated manually by the control panel receiver or remotely with the key fob.

Figure 1:
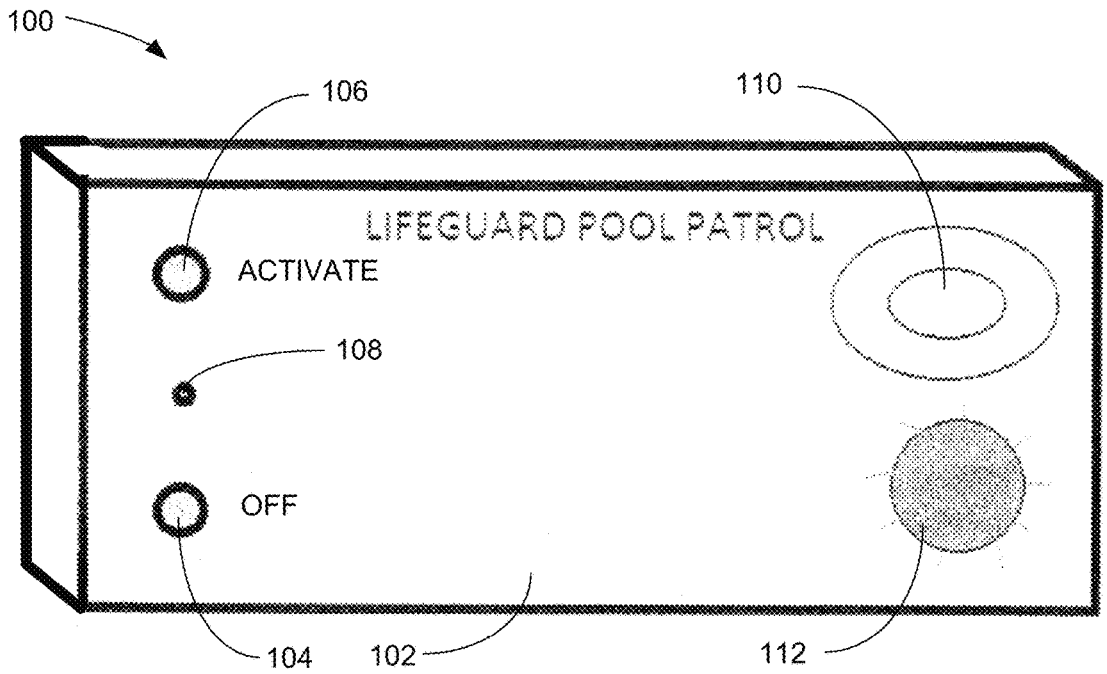
FIG. 1 is a front perspective view illustrating an exemplary main control panel receiver, according to a preferred embodiment of the present invention.

FIG. 1 is a front perspective view illustrating an exemplary main control panel receiver 100, according to a preferred embodiment of the present invention. The control panel receiver 100 consists of a housing 102 supporting an ACTIVATE button 106, an OFF button 104, a small green LED 108, a large red LED 112, and a speaker 110. The ACTIVATE button 106, once pushed, will activate the motion sensor transmitters 300 (see FIGS. 3A-3B) in the swimming pool 400 (see FIG. 4). The small green LED light will turn on once the alarm is activated 108. The OFF button 104 will deactivate the alarm, once pushed, and turn off the small green LED 108. The large red LED 112 will flash when the alarm is triggered and will only stop flashing when the alarm is turned off. The speaker 110 broadcasts a voice alert "pool alarm activated" when it is turned on and "pool alarm deactivated" when it is turned off. Speaker 110 will also sound off the alarm when it is triggered. A built-in receiver in the control panel will take in the information sent from the motion sensor transmitters 300 (see FIGS. 3A-3B) in the pool and sound the alarm and start the large red LED 112 flashing.

Figure 2:
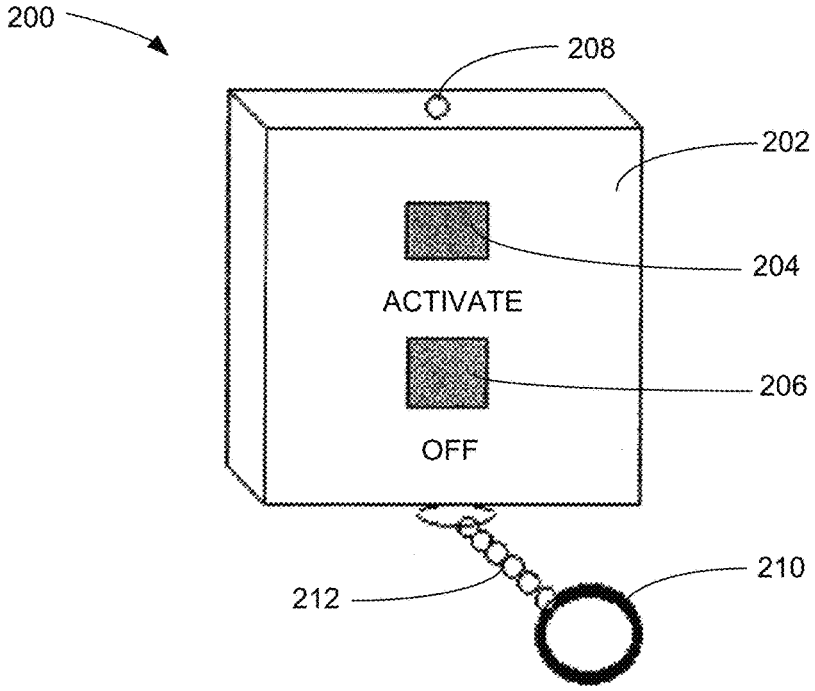
FIG. 2 is a front perspective view illustrating an exemplary remote control key chain fob, according to a preferred embodiment of the present invention.

FIG. 2 is a front perspective view illustrating an exemplary remote control key chain fob 200, according to a preferred embodiment of the present invention. Remote control key chain fob 200 includes a housing supporting an ACTIVATE button 204, and OFF button 206, and activation indicator LED 208, and key chain 212 which supports key ring 210. Remote control key chain fob 200 enables remote access to the control panel receiver 100.

Figure 3A:
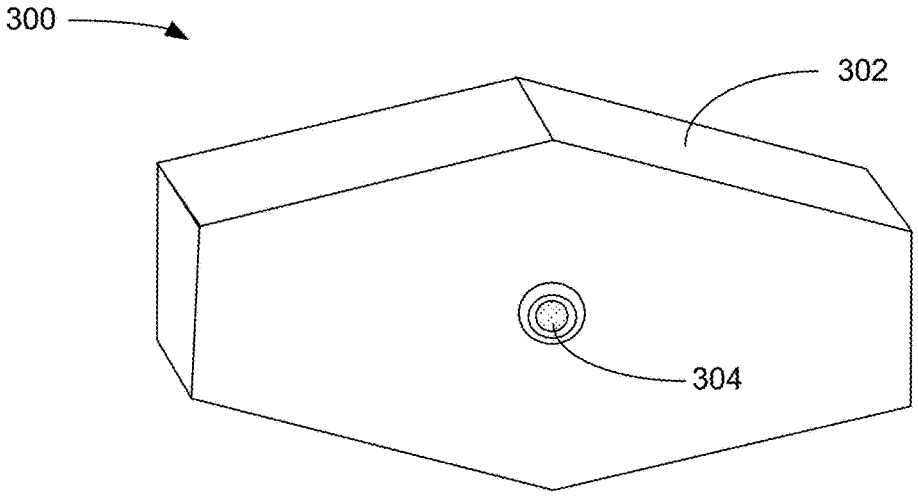
FIG. 3A is a front perspective view illustrating an exemplary pool motion sensor and transmitter, according to a preferred embodiment of the present invention.

FIG. 3A is a front perspective view illustrating an exemplary pool motion sensor and transmitter 300, according to a preferred embodiment of the present invention. The pool motion sensor transmitters 300 are preferably hexagonal in shape and are installed horizontally with the beam emitter/sensor 304 center facing towards the water just above the waterline. The transmitters have a water-resistant housing 302. Pool motion sensor transmitters 300 are powered by a water-proof battery accessible via a battery compartment cover 308 (see FIG. 3B) in the back of the housing 302 of the pool motion sensor transmitter 300. The emitted beams will connect to one another creating a field that will sense motion if one beam is broken. Once an individual enters the water when the alarm has been activated, the water level will rise and break the continuous beam, causing the transmitter to relay the information to the receiver in the control panel 100. Thus, triggering the alarm sound from speaker 110 and the flashing red LED light 112.

Figure 3B:
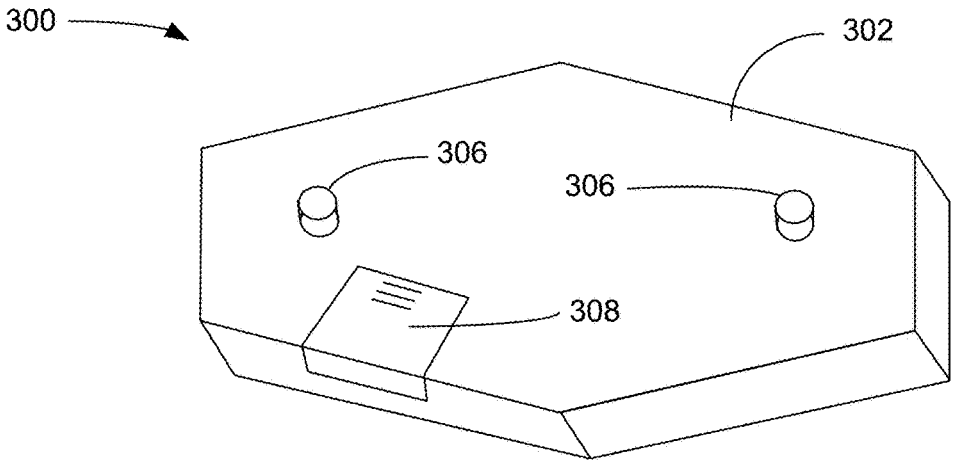
FIG. 3B is a rear perspective view illustrating an exemplary pool motion sensor and transmitter of FIG. 3A, according to a preferred embodiment of the present invention.
Figure 4:
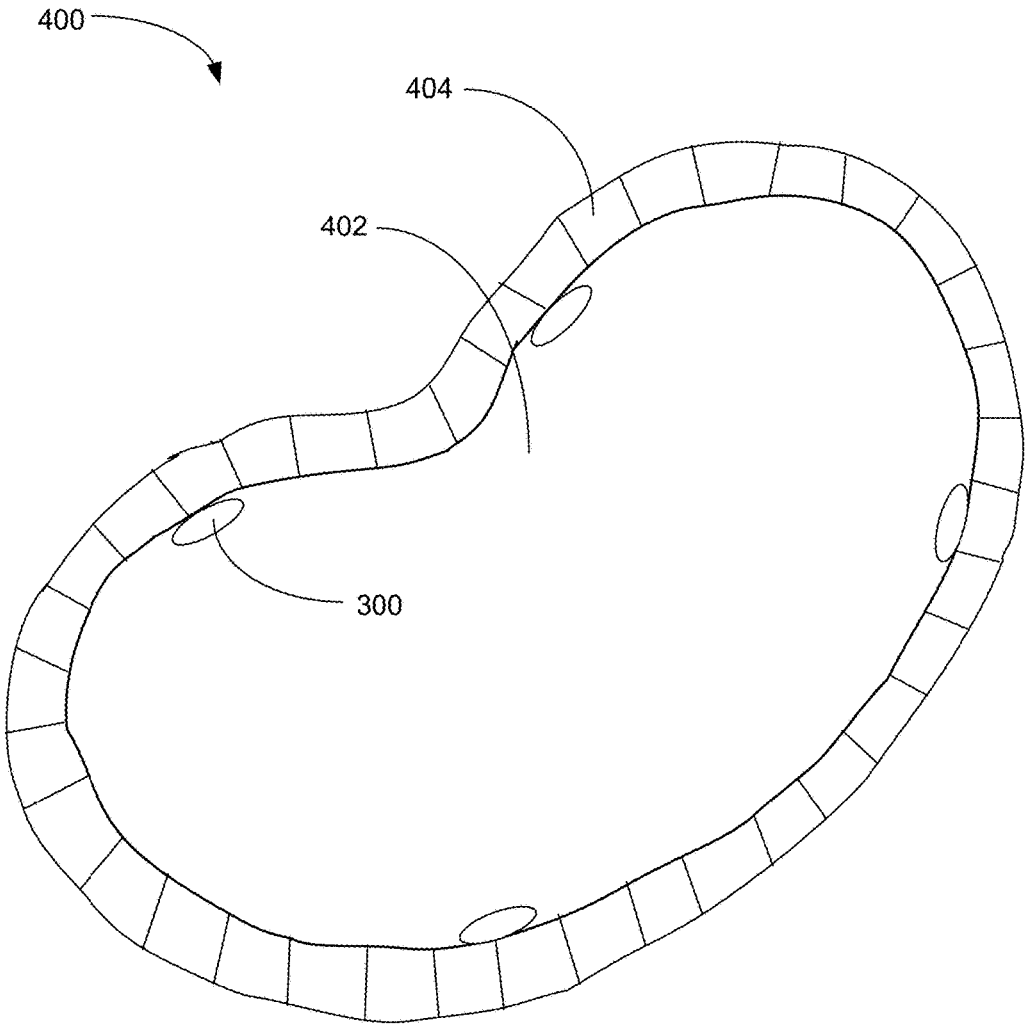
FIG. 4 is a top plan view illustrating an exemplary swimming pool with a plurality of motion sensor transmitters installed around the perimeter, according to a preferred embodiment of the present invention.

FIG. 3B is a rear perspective view illustrating an exemplary pool motion sensor and transmitter 300 of FIG. 3A, according to a preferred embodiment of the present invention, Pegs 306 assist in mounting pool motion sensor and transmitter 300 to a wall of the pool 400 (see FIG. 4). Battery compartment cover 308 is preferably water resistant.

Figure 3C:
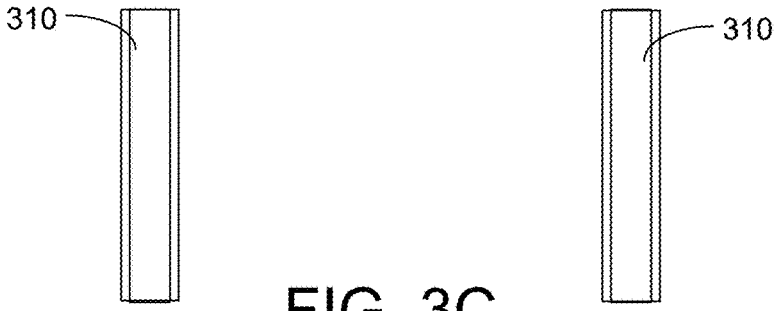
FIG. 3C is a front elevation view illustrating the pool motion sensor transmitter track, according to a preferred embodiment of the present invention.

FIG. 3C is a front elevation view illustrating the pool motion sensor transmitter track 310, according to a preferred embodiment of the present invention. Pool motion sensor transmitter track 310 is preferably held onto the pool 400 (see FIG. 4) wall by a water-proof glue. Pool motion sensor transmitter can easily be placed into and held by the track 310 in the pool 400 (see FIG. 4) via pegs 306. Pool motion sensor transmitter 300 can also be easily removed to change the water-proof battery. The pool motion sensor transmitter track 310 is preferably made of plastic and is held in place by a water-proof glue. Pegs 306 located on the back of the housing 302 for the pool motion sensor transmitter 300 fit into the tracks 310 and slide down in the tracks 310, locking into place at the bottom of the track 310. When having to change the water-proof battery, slide the pool motion sensor transmitter 300 up the tracks 310 and out. The battery compartment door 308 located on the back of the housing 302 is a simple slide-lock mechanism that can be slid with the thumb or finger. The battery can be swapped out, the compartment door 308 slid back into place and the pool motion sensor transmitter 300 slid back down the tracks 310, locking into place.

FIG. 4 is a top plan view illustrating an exemplary swimming pool 400 with a plurality of motion sensor transmitters 300 installed around the perimeter, according to a preferred embodiment of the present invention. The pool motion sensor transmitters 300 are placed directly across from each other creating a continuous beam. Once that beam is displaced by the water rising after someone enters, the alarm will trigger. The housing 302 for the transmitter is made of injection-molded polypropylene and a die cut rubber seal.

I claim:

1. A pool alarm comprising:
- a. a control panel receiver;
- b. a key fob remote;
- c. at least two motion sensors; and
- d. a plurality of transmitters, communicatively coupling said at least two motion sensors to said control panel receiver; and
- e. wherein said key fob remote comprises:
  - i. an activation switch;
  - ii. a deactivation switch;
  - iii. a transmitter; and
  - iv. an LED operable to indicate activation.

2. The pool alarm of claim 1, comprising first and second motion sensors of said at least two motion sensors secured to a wall of said pool on opposed sides of said pool and oriented to face one another.

3. The pool alarm of claim 2, comprising a housing supporting:
- a. each said motion sensor of said plurality of said motion sensors; and
- b. each said transmitter of said plurality of transmitters.

4. The pool alarm of claim 3, wherein said housing comprises a hexagonal shape.

5. The pool alarm of claim 3, comprising a plurality of pairs of tracks affixed to said wall of said pool, operable to engage first and second pegs extending from said housing.

6. The pool alarm of claim 2, wherein said first and second motion sensors are positioned just above a surface of water in said pool.

7. The pool alarm of claim 2, wherein said first and second motion sensors have a surface of water in said pool within first and second fields of view of said first and second motion sensors, respectively.

8. The pool alarm of claim 1, wherein said control panel receiver comprises:
- a. an activation switch;
- b. a first LED that is operable to indicate activation;
- c. an off switch;
- d. a receiver;
- e. a speaker; and
- f. a second LED that is operable to indicate an alarm condition.

9. The pool alarm of claim 1, wherein said transmitter of said key fob remote is operable to communicatively connect to said control panel receiver.

10. A pool alarm comprising:

a. a control panel receiver further comprising:
   i. an activation switch;
   ii. a first LED that is operable to indicate activation;
   iii. an off switch;
   iv. a receiver;
   v. a speaker; and
   vi. a second LED that is operable to indicate an alarm condition;

b. a key fob remote;

c. at least two motion sensors; and d. a plurality of transmitters, communicatively coupling said at least two motion sensors to said control panel receiver;

e. wherein said key fob remote comprises:
   i. an activation switch;
   ii. a deactivation switch;
   iii. a transmitter; and
   iv. an LED operable to indicate activation.

11. The pool alarm of claim 10, comprising a housing supporting:

a. each said motion sensor of said plurality of said motion sensors; and b. each said transmitter of said plurality of transmitters.

12. The pool alarm of claim 10, wherein said transmitter of said key fob remote is operable to communicatively connect to said control panel receiver.

13. The pool alarm of claim 10, comprising:

a. first and second motion sensors of said at least two motion sensors secured to a wall of said swimming pool on opposed sides of said pool and oriented to face one another;

b. a housing supporting:
   i. each said motion sensor of said plurality of said motion sensors; and
   ii. each said transmitter of said plurality of transmitters.

14. The pool alarm of claim 13, comprising a plurality of pairs of tracks affixed to said wall of said pool, operable to engage first and second pegs extending from said housing, wherein said first and second motion sensors are positioned just above a surface of water in said pool.

15. The pool alarm of claim 13, wherein said first and second motion sensors have a surface of water in said pool within first and second fields of view of said first and second motion sensors, respectively.

16. A pool alarm comprising:

a. a control panel receiver further comprising:
   i. an activation switch;
   ii. a first LED that is operable to indicate activation;
   iii. an off switch;
   iv. a receiver;
   v. a speaker; and
   vi. a second LED that is operable to indicate an alarm condition;

b. a key fob remote, comprising:
   i. an activation switch;
   ii. a deactivation switch;
   iii. a transmitter; wherein said transmitter of said key fob remote is operable to communicatively connect to said control panel receiver; and
   iv. an LED operable to indicate activation;

c. a plurality of transmitters, communicatively coupling at least two motion sensors to said control panel receiver; and d. said at least two motion sensors, further comprising a housing supporting:
   i. each said motion sensor of said plurality of said motion sensors; and
   ii. each said transmitter of said plurality of transmitters.

17. The pool alarm of claim 16, comprising:

a. first and second motion sensors of said at least two motion sensors secured to a wall of said swimming pool on opposed sides of said pool and oriented to face one another;

b. a housing supporting:
   i. each said motion sensor of said plurality of said motion sensors; and
   ii. each said transmitter of said plurality of transmitters;

c. a plurality of pairs of tracks affixed to said wall of said pool, operable to engage first and second pegs extending from said housing, wherein said first and second motion sensors are positioned just above a surface of water in said pool.

18. The pool alarm of claim 17, wherein said first and second motion sensors have a surface of water in said pool within first and second fields of view of said first and second motion sensors, respectively.

* * * * *